US005148647A

United States Patent [19]

Rutledge

[11] Patent Number: 5,148,647

[45] Date of Patent: Sep. 22, 1992

[54] ROOF MOUNTING CURB

[75] Inventor: Phillip R. Rutledge, Farmers Branch, Tex.

[73] Assignee: Rooftop Systems Inc., Carrollton, Tex.

[21] Appl. No.: 746,469

[22] Filed: Aug. 16, 1991

[51] Int. Cl.[5] ..... E04B 1/24

[52] U.S. Cl. ..... 52/488; 52/585; 52/376; 52/475; 52/71; 52/668

[58] Field of Search ..... 52/488, 475, 585, 71, 52/664, 668, 669, 376

[56] References Cited

U.S. PATENT DOCUMENTS 3,462,181 4/1967 Lewis ..... 52/585
4,156,999 6/1979 Avery ..... 52/376

FOREIGN PATENT DOCUMENTS 2719296 4/1977 Fed. Rep. of Germany ..... 52/488

*Primary Examiner*—David A. Scherbel
*Assistant Examiner*—Wynn E. Wood
*Attorney, Agent, or Firm*—M. H. Gay

[57] ABSTRACT

A roof mounting curb which may have its sides formed with hinge ears and hinge pin inserted into the ears to secure the curb sides to each other. Slots are provided in the curb sides and may be provided in the duct supports to position the duct supports.

6 Claims, 3 Drawing Sheets

ROOF MOUNTING CURB

This invention relates to curbs for mounting on roofs to support air moving equipment such as fans or air conditioners for cooling or heating air or any other rooftop appliance.

Roof mounting curbs are well known. They generally employ curb sides which are fastened together by angle fittings bolted to adjacent curb sides. Duct supports have been extended across the curb sides and fastened to the curb sides with screws. Assembling the known roof mounting curb has been a laborious and time consuming task.

It is an object of this invention to provide a new roof mounting curb in which the curb sides are secured together without the use of angle members, bolts, screws or the like.

It is another object of this invention to provide a roof mounting curb in which the curb sides are secured together by the insertion of a single pin at each corner.

It is another object of this invention to provide a new roof mounting curb in which duct supports are positioned on the curb sides in predetermined positions and may be latched in such positions by simple means such as inserting tongues on the supports in slots.

Other objects, features and advantages of this invention will be apparent from the drawings, the specification and the claims.

In the drawings, wherein like reference numerals indicate like parts and wherein an illustrative embodiment of this invention is shown:

Figure 2:
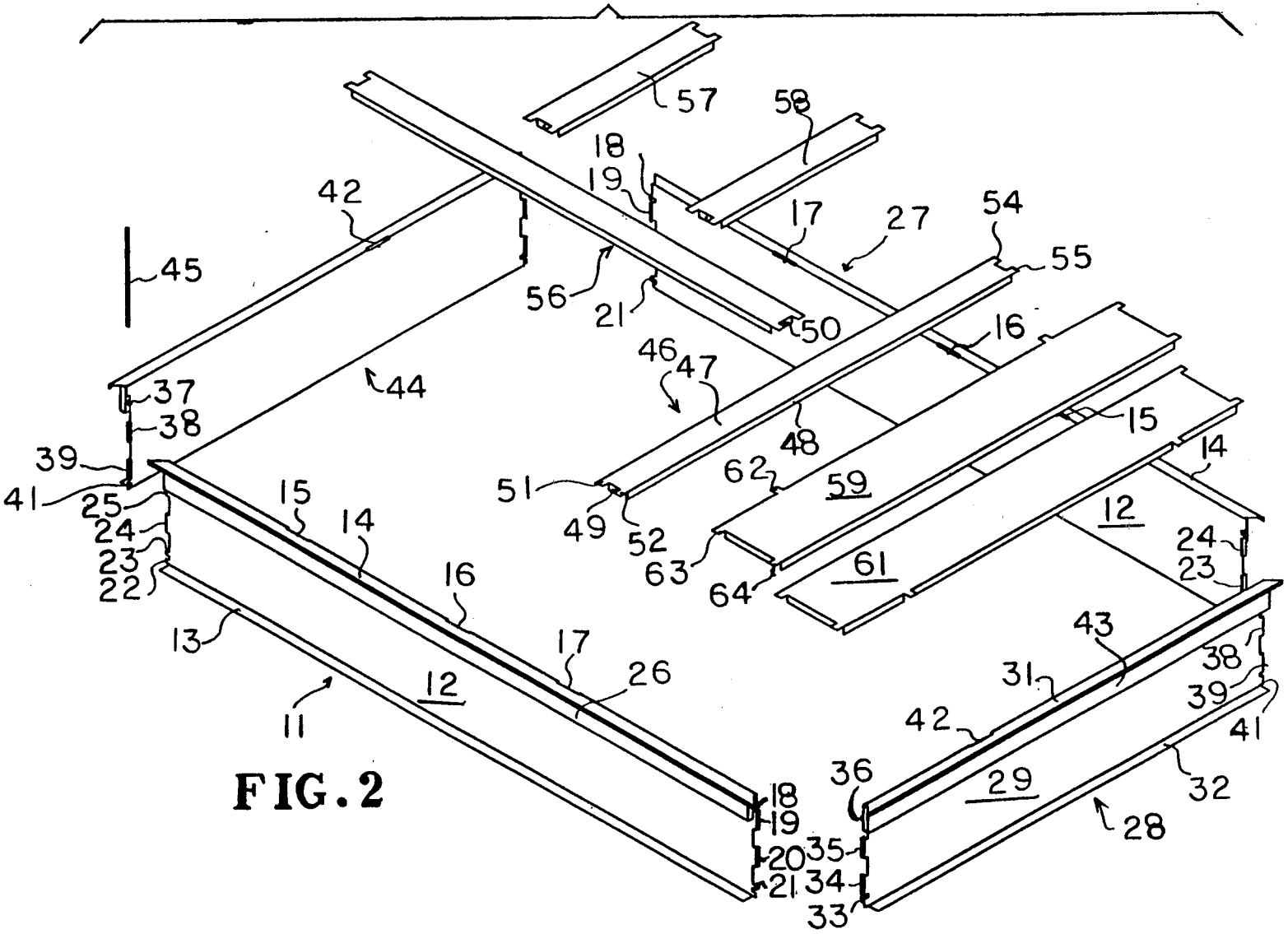
FIG. 2 is an exploded view of the curb of FIG. 1.

Referring first to FIG. 2, the curb side indicated generally at 11 is formed into channel shaped sheet metal and includes a web 12, a lower flange 13, and an upper flange 14. The flange 13 extends outwardly of the curb and is designed to rest on a roof and may be fastened thereto in the conventional fashion.

The upper flange 14 also extends outwardly of the curb and may have one or more slots, such as slots 15, 16, and 17 therein. These slots are in the upper flange immediately adjacent the web of the curb side and locate the duct supports as will appear hereinafter.

At one end of the curb side 11 hinge ears 18, 19, 20 and 21 are formed from the web of the channel shaped metal member and extend from the web 12. The ears are integral with the web 12 and are shaped to receive a pin in the manner of a hinge, although the structure does not function as a hinge, except in squaring the curb. The primary function of the hinge ears are to receive a pin which fastens adjacent curb sides to each other. At its opposite end the curb side 11 also has hinge ears 22, 23, 24, and 25 which function in the above described manner to receive a hinge pin and secure adjacent curb sides together.

A nailer strip 26 is secured to the curb side in any desired manner, such as by screws, (not shown) against the web 12 and adjacent the upper flange 14. The nailer strip 26 preferably also lies against the upper web 12. The nailer strip provides for anchoring the roof felt to the curb in the conventional manner. As in conventional practice, insulation material may be positioned against the web 12 and underlie the roof felt.

The opposite curb side indicated generally at 27 is identical in construction to curb side 11.

A third curb side, indicated generally at 28 extends between one end of curb sides 11 and 27. Although shown to be of lesser length the curb side is again fabricated into channel shaped metal and has a web 29 and upper outturned flange 31 and lower outturned flange 32. Hinge ears 33, 34, 35 and 36 are formed in the web 29 at one end of the curb side. They cooperate with hinge ears 18, 19, 20 and 21 in curb side 11 to receive a hinge pin and latch the two curb sides 11 and 28 together.

Hinge ears 37 (FIG. 3), 38, 39 and 41 are formed in the web 29 of curb side 28 at its other end to receive a hinge pin and latch curb sides 27 and 28 together.

One or more slots 42 may be formed in the upper flange to support and position duct supports. A nailer strip 43 is secured to the web 29 adjacent the upper flange to provide for attachment of the roof felt.

A fourth curb side indicated generally at 44 may complete the roof mounting curb. This curb side 44 may be identical to curb side 28.

Figure 3:
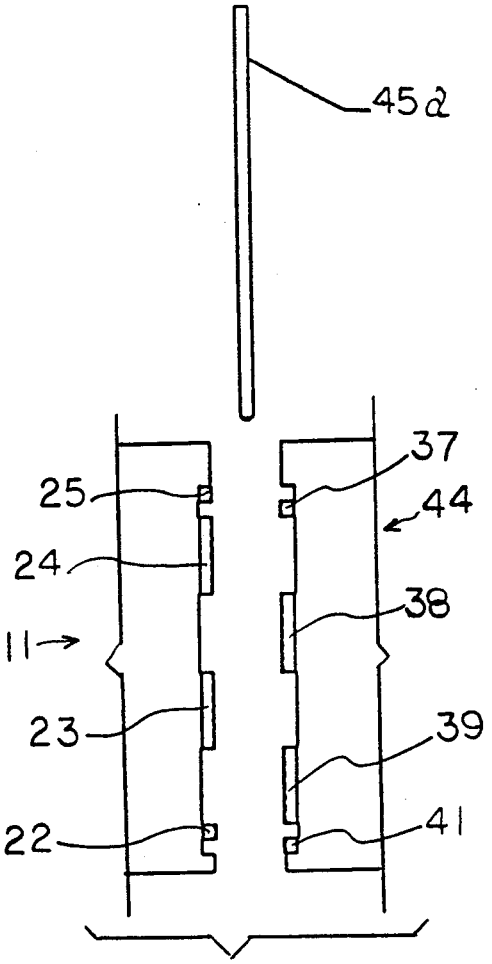
FIG. 3 is an enlarged fragmentary exploded view in elevation from the interior, of one corner of the curb of FIG. 1 employing a square hinge pin.
Figure 4:
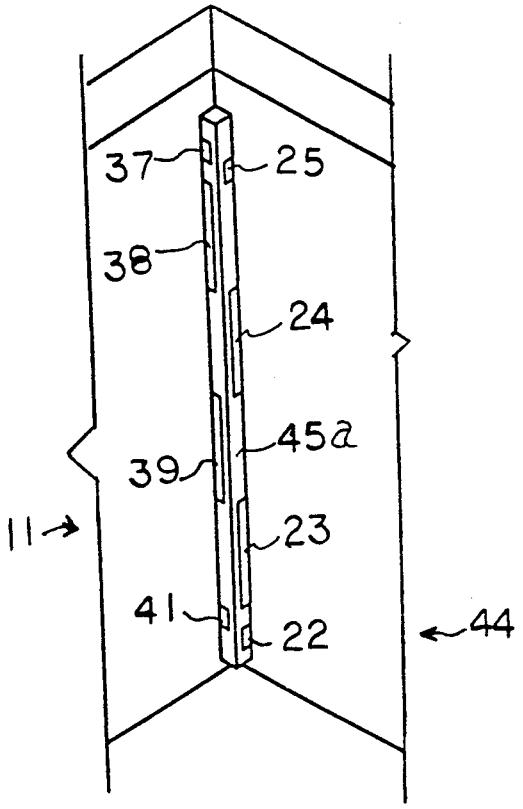
FIG. 4 is an assembled fragmentary view in perspective of the corner of FIG. 3.

In assembling the roof curb the curb sides will be positioned in generally rectangular relationship and a hinge pin 45 inserted in the hinge ears at each corner to latch adjacent curb sides together. The hinge ears may be round or square in configuration and receive round pin 45 or square hinge pin **45*a* (FIGS. 3 and 4**).

With the curb assembled, it may be checked for square in the conventional manner and attached to the roof. Thereafter insulation and the roof felt may be applied to the sides of the curb in the conventional manner. The roof mounting curb may be utilized to support a fan or a duct may extend through the curb to a fan to provide for moving air through the roof curb. The curb may also support an air conditioning unit or any other roof top appliance.

While a four sided roof curb is illustrated, it will be appreciated that additional sides may be provided within the concept of this invention, but ordinarily only four sides are provided.

When the curb is to be used with a duct system for air conditioning, duct supports are preferably provided. These supports may extend between the curb sides in any desired manner.

In accordance with this invention the duct supports are formed into channel shaped metal having at least a portion of the web extending beyond the flanges and bent to extend perpendicular to the web to provide a tongue to engage the slots in the curb sides to position the duct supports.

A first duct support indicated generally at 46 has a web 47 and a down turned flange 48. A similar down turned flange 60 (FIG. 5) is provided on the other side of the web. At one end the web has a center tongue section 49 bent downwardly and extending perpendicular to the remainder of the web. Preferably the two sections 51 and 52 on opposite sides of the tongue section extend in the plane of the web 47. With this construction the tongue section 49 may extend into a slot such as slot 17 in curb side 11. The tongue section 49 will correctly position the duct support 46 and the two sections 51 and 52 will rest on the flange 14 of curb side 11 to support the duct support.

Figure 5:
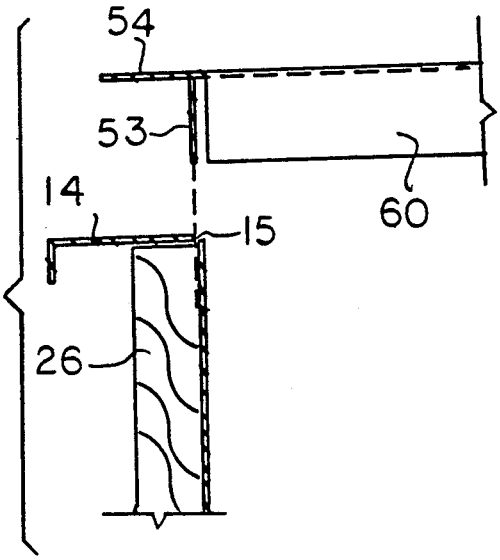
FIG. 5 is an exploded view of a fragment of one curb side in section and a view in elevation of a fragment of a duct support in position to be inserted into the curb side.

The opposite end of the duct support is constructed in the same manner and has a center downwardly bent tongue section 53 (FIG. 5.) and two sections 54 and 55 in the plane of the remainder of the web to support the duct support on the flange 14 of curb side 27 when the tongue section 49 extends into slot 15 in curb side 27. FIG. 5 illustrates the manner in which the tongue 53 and like tongues of other duct supports extend through the slots such as slot 14 between the web of the curb side and the nailer 26, and the sections such as section 54 overly the upper flanges of the curb sides to support the duct supports.

Positioning slots (not shown) may be provided in the duct supports and additional duct supports extended across the roof curb to support equipment such as air ducts. These additional duct supports may be of the same construction as duct support 46, but may be of different length. Thus in the roof curb shown a first additional duct support indicated generally at 56 may extend between the duct support 46 and curb side 44. Second and third duct supports 57 and 58 may extending between curb side 27 and the first additional duct support 56. This arrangement will result in multiple openings through which air duct may extend and may be secured to the duct supports in the conventional manner.

If slots are not provided in the webs of the duct supports, fasteners may secure the tongues the support to the flanges of duct supports. Thus, in the absence of a slot in duct support 46 to receive a tongue of duct support 56, a fastener will be extended through hole 50 in the tongue of duct support 56 and secure the tongue to the flange 60 of duct support 46. If desired like holes may be provided in all duct support tongues; and fasteners, such as metal screws, may extend through these holes to secure the duct supports to the curb sides and other duct supports.

While slots will be positioned in the curb sides for standard positions of the duct supports, field conditions may dictate other positions for the duct supports. In this event the tongues will be positioned internally of the curb sides and fasteners such as metal screws may be utilized to secure the duct supports at the desired location in the curb.

Figure 1:
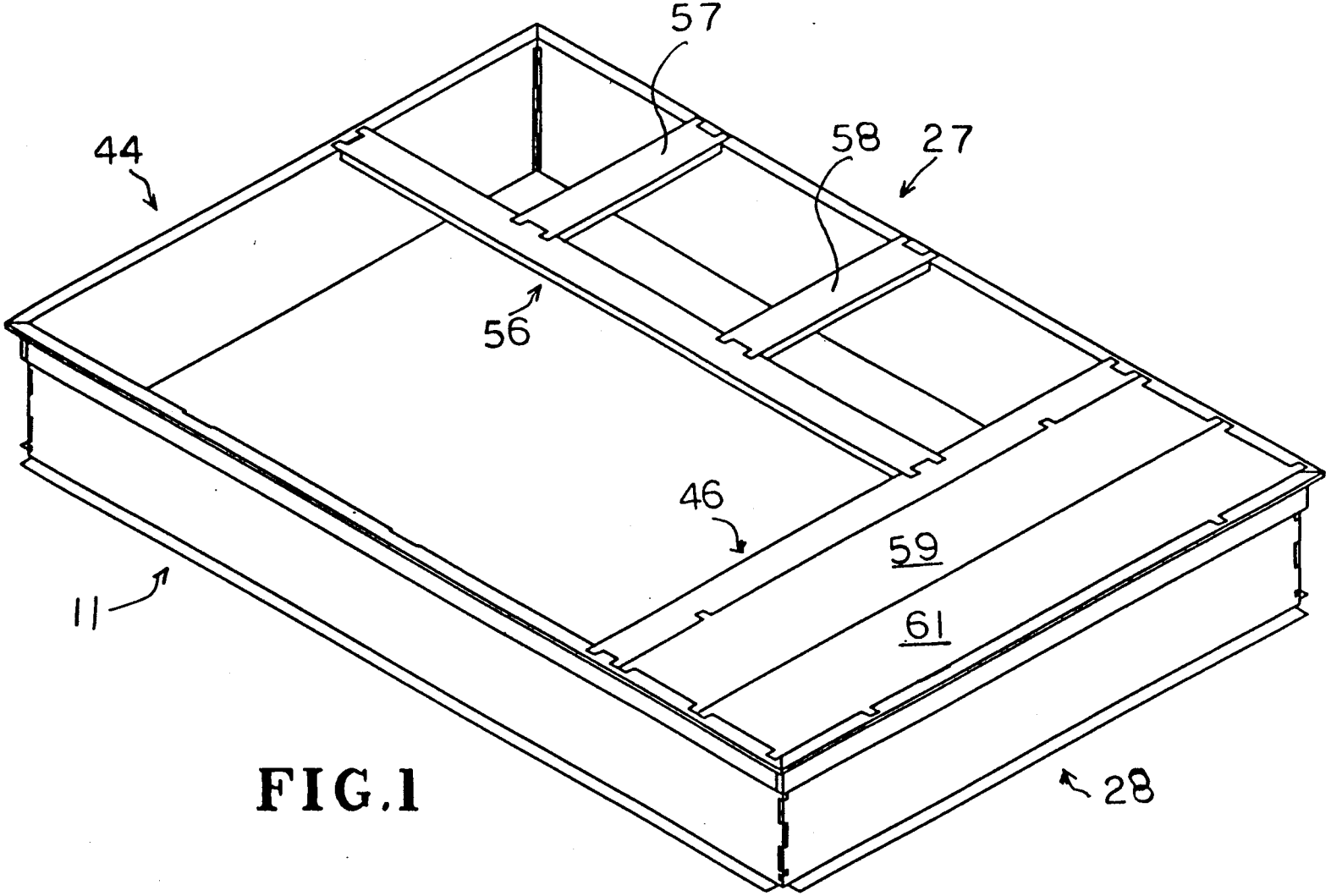
FIG. 1 is a perspective view of an assembled roof mounting curb constructed in accordance with this invention.

If desired blank off panels may cover a portion of the roof curb. Such panels are shown at 59 and 61 These panels may have fingers extending from the panels such as at 62, 63 and 64 overlying the curb sides and duct supports as shown in FIGS. 1 and 2. These fingers are formed form the panels by forming the ends of the panels in the same manner as the duct supports so that the center sections provide tongues which will contact the curb sides on their interior surfaces and the side sections will overlie the curbs. Fingers 62 may be formed from the flanges of the panels and overly adjacent structures, such as the curb sides and the duct supports as illustrated.

The panels may support insulation material if desired and will ordinarily be used to underlie the condenser section of an air conditioning unit.

The foregoing disclosure and description of the invention are illustrative and explanatory thereof and various changes in the method and apparatus and system and in the size, shape and materials, as well as in the details of the illustrated construction, may be made within the scope of the claims without departing from the spirit of the invention.

What is claimed is:

1. Roof mounting curb comprising:

at least 4 curb sides formed of channel shaped sheet metal having a web and opposing upper and lower flanges, said curb sides further having hinge ears formed on each end thereof extending from said curb sides further said web of the channel shaped metal, each curb side having a wood nailer strip contacting said web and said opposing upper flange of each curb side, and hinge pins insertable in the hinge ears of adjacent curb sides squaring the curb sides together.

2. The curb of claim 1 wherein:

the curb is formed from 4 curb sides, said hinge pins are square in cross section, and said hinge ears are formed with square sides to receive said square hinge pins and align said curb sides in rectangular configuration.

3. Roof mounting curb comprising:

at least 4 curb sides formed of channel shaped metal having a web and opposing and lower upper flanges said curb sides further having hinge ears formed on each end thereof extending from said web of the channel shaped metal each curb side having a wood nailer strip contacting said web and said opposing upper flange of each curb side, and at least 3 curb sides having at least one slot in said flange of the curb side adjacent the web of the curb side and adjacent the nailer strip, hinge pins insertable in the hinge ears of adjacent curb sides squaring the curb sides together, a first channel shaped duct support having its web extending beyond its flanges on each end and bent to provide a tongue on each end extending perpendicular to the web, said first duct support having its tongues received in said slots in two of said curb sides, said first duct support having at least one slot in said web adjacent one of its flanges, and at least one additional channel shaped duct support having its web extending beyond its flanges on each end and bent to provide a tongue on each end extending perpendicular to the web, said additional duct support having its tongues received in said slots in said first duct support and one of said curb sides.

4. The curb of claim 3 wherein each of said duct supports has a portion of its web extending from each end and overlying said flange through which said tongue extends.

5. The curb of claim 3 wherein second and third additional duct supports are provided and extend between said one additional duct support and one of said curb sides.

6. The curb of claim 5 wherein impervious blank-off panels extend between said first duct support and one of said curb sides.

* * * * *